US009487714B2

(12) United States Patent
Novak et al.

(10) Patent No.: US 9,487,714 B2
(45) Date of Patent: Nov. 8, 2016

(54) HYDROCRACKING PROCESS SELECTIVE FOR IMPROVED DISTILLATE AND IMPROVED LUBE YIELD AND PROPERTIES

(71) Applicants: William J. Novak, Bedminster, NJ (US); Robert Allen Bradway, Vienna, VA (US); Stuart S. Shih, Gainesville, VA (US); Timothy Lee Hilbert, Fairfax, VA (US); Michel Daage, Hellertown, PA (US)

(72) Inventors: William J. Novak, Bedminster, NJ (US); Robert Allen Bradway, Vienna, VA (US); Stuart S. Shih, Gainesville, VA (US); Timothy Lee Hilbert, Fairfax, VA (US); Michel Daage, Hellertown, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 451 days.

(21) Appl. No.: 14/011,061

(22) Filed: Aug. 27, 2013

(65) Prior Publication Data

US 2013/0341243 A1 Dec. 26, 2013

Related U.S. Application Data

(63) Continuation of application No. 13/237,361, filed on Sep. 20, 2011, now Pat. No. 8,557,106.

(60) Provisional application No. 61/388,327, filed on Sep. 30, 2010.

(51) Int. Cl.

| | |
|---|---|
| ***C10G 47/18*** | (2006.01) |
| ***C10G 49/04*** | (2006.01) |
| ***C10G 65/10*** | (2006.01) |
| ***C10G 65/12*** | (2006.01) |

(52) U.S. Cl.

CPC ..... *C10G 65/10* (2013.01); *C10G 47/18* (2013.01); *C10G 49/04* (2013.01); *C10G 65/12* (2013.01); *C10G 2300/1074* (2013.01); *C10G 2300/202* (2013.01); *C10G 2300/301* (2013.01); *C10G 2300/302* (2013.01); *C10G 2300/304* (2013.01); *C10G 2300/307* (2013.01); *C10G 2300/4018* (2013.01); *C10G 2300/4025* (2013.01); *C10G 2400/04* (2013.01); *C10G 2400/08* (2013.01); *C10G 2400/10* (2013.01)

(58) Field of Classification Search

CPC ..... C10G 2300/1074; C10G 2300/202; C10G 2300/301; C10G 2300/302; C10G 2300/304; C10G 2300/307; C10G 2300/4018; C10G 2300/4025; C10G 2400/04; C10G 2400/08; C10G 2400/10; C10G 47/18; C10G 49/04; C10G 65/10; C10G 65/12

See application file for complete search history.

(56) References Cited

U.S. PATENT DOCUMENTS

| | | | |
|---|---|---|---|
| 3,232,863 | A | 2/1966 | Watson et al. |
| 3,419,497 | A | 12/1968 | Rocchini et al. |
| 3,450,636 | A | 6/1969 | Rausch |
| 3,640,868 | A | 2/1972 | Rocchini et al. |
| 4,515,680 | A | 5/1985 | Hettinger, Jr. et al. |
| 5,282,958 | A | 2/1994 | Santilli et al. |
| 5,333,698 | A | 8/1994 | Van Slyke |
| 5,688,748 | A | 11/1997 | Tomizawa |
| 5,953,414 | A | 9/1999 | Abraham et al. |
| 6,156,695 | A | 12/2000 | Soled et al. |
| 6,162,350 | A | 12/2000 | Soled et al. |
| 6,299,760 | B1 | 10/2001 | Soled et al. |
| 6,413,412 | B1 | 7/2002 | Peng et al. |
| 6,582,590 | B1 | 6/2003 | Riley et al. |
| 6,652,735 | B2 | 11/2003 | Degnan et al. |
| 6,712,955 | B1 | 3/2004 | Hou et al. |
| 6,723,889 | B2 | 4/2004 | Miller et al. |
| 6,783,663 | B1 | 8/2004 | Riley et al. |
| 6,863,803 | B1 | 3/2005 | Riley et al. |
| 6,929,738 | B1 | 8/2005 | Riley et al. |
| 7,077,948 | B1 | 7/2006 | Barre et al. |
| 7,229,548 | B2 | 6/2007 | Riley et al. |
| 7,261,805 | B2 | 8/2007 | Grove et al. |
| 7,288,182 | B1 | 10/2007 | Soled et al. |
| 7,300,900 | B2 | 11/2007 | Benazzi et al. |
| 7,410,924 | B2 | 8/2008 | Corma Canos et al. |
| 7,544,632 | B2 | 6/2009 | Soled et al. |

(Continued)

FOREIGN PATENT DOCUMENTS

| | | | |
|---|---|---|---|
| EP | 0208361 | B1 | 11/1991 |
| EP | 0649896 | B1 | 11/1994 |
| EP | 0743351 | B1 | 8/2000 |
| WO | 2004007646 | A1 | 1/2004 |
| WO | 2007084437 | A2 | 7/2007 |

(Continued)

OTHER PUBLICATIONS

Detusheva, E.P.; Shkol'Nikov,V.M.; Khramtsova, L.P.; Muchinskii, Ya.D., "Characteristics of naphthene-paraffin hydrocarbons of residual oil from western Siberian petroleums", Khimiya i Tekhnologiya Topliv i Masel, (1983), pp. 30-31, vol. 9.

(Continued)

*Primary Examiner* — Walter D Griffin

*Assistant Examiner* — Derek Mueller

(74) *Attorney, Agent, or Firm* — Chad A. Guice; Robert A. Migliorini

(57) ABSTRACT

This invention relates to a process involving hydrocracking of a feedstream in which a converted fraction can exhibit relatively high distillate product yields and maintained or improved distillate fuel properties, while an unconverted fraction can exhibit improved properties particularly useful in the lubricant area. In this hydrocracking process, it can be advantageous for the yield of converted/unconverted product for gasoline fuel application to be reduced or minimized, relative to converted distillate fuel and unconverted lubricant. Catalysts and conditions can be chosen to assist in attaining, or to optimize, desirable product yields and/or properties.

17 Claims, No Drawings

(56) References Cited

U.S. PATENT DOCUMENTS

| | | | |
|---|---|---|---|
| 2003/0085154 | A1 | 5/2003 | Benazzi et al. |
| 2003/0211949 | A1 | 11/2003 | Guyomar et al. |
| 2004/0050753 | A1 | 3/2004 | Marion et al. |
| 2004/0118744 | A1 | 6/2004 | Daniel et al. |
| 2005/0277545 | A1 | 12/2005 | Shih et al. |
| 2006/0060502 | A1 | 3/2006 | Soled et al. |
| 2006/0100466 | A1 | 5/2006 | Holmes et al. |
| 2007/0084754 | A1 | 4/2007 | Soled et al. |
| 2008/0015400 | A1 | 1/2008 | Matsui et al. |
| 2008/0132407 | A1 | 6/2008 | Bai et al. |
| 2008/0171675 | A1 | 7/2008 | Yeh et al. |
| 2009/0166256 | A1 | 7/2009 | Lewis et al. |

FOREIGN PATENT DOCUMENTS

| | | | |
|---|---|---|---|
| WO | 2007084438 | A2 | 7/2007 |
| WO | 2007084439 | A1 | 7/2007 |
| WO | 2007084471 | A1 | 7/2007 |

OTHER PUBLICATIONS

Galiano-Roth, A.S.; Page, N.M., "Effect of hydroprocessing on lubricant base stock composition and product performance", Lubrication Engineering, (1994), pp. 659-664, vol. 50, Iss. 8.

Montanari, Luciano; Montani, E.; Corno, C.; Fattori, S., "NMR molecular characterization of lubricating base oils. Correlation with their performance Chemical Abstracts", Applied Magnetic Resonance, (1998), pp. 345-356, vol. 14.

HYDROCRACKING PROCESS SELECTIVE FOR IMPROVED DISTILLATE AND IMPROVED LUBE YIELD AND PROPERTIES

CROSS-REFERENCE TO RELATED APPLICATIONS

This application is a Continuation application of U.S. Non-Provisional application Ser. No. 13/237,361 filed Sep. 20, 2011 which claims the benefit of U.S. Provisional Application No. 61/388,327 filed Sep. 30, 2010, which is herein incorporated by reference in its entirety.

FIELD OF THE INVENTION

This invention relates to a process involving hydrocracking of a feedstream in which a converted fraction can exhibit relatively high distillate product yields and maintained or improved distillate fuel properties, while an unconverted fraction can exhibit improved properties particularly useful in the lubricant area.

BACKGROUND OF THE INVENTION

Hydrocracking of relatively high boiling point hydrocarbons, such as atmospheric and vacuum gasoil cuts from crude oil, is generally done to form a converted product having a more useful boiling point, so that it can be predominantly used in any one or more of a variety of fuels, such as naphtha (motor gasoline), jet fuel, kerosene, diesel, and the like. Usually, however, the hydrocracking reaction is run at relatively low severity or relatively low hydrocracking conversion, so that the higher boiling point hydrocarbons are not cracked too much, as higher conversions typically generate increasing quantities of material boiling in the ranges below naphtha, which low boiling material tends not to be as commercially useful as the fuel compositions.

Additionally, low conversions also leave behind higher quantities of higher boiling range hydrocarbons that cannot be used as fuels and that tend to have poor properties for use in such applications as lubricants, without further significant processing steps. Such steps can add complexity and cost to dealing with such otherwise unusable higher boiling range hydrocarbons, and options such as coking for such hydrocarbons can offer relatively marginal return on investment.

Indeed, there are many patent publications that disclose hydrocracking processes for attaining good fuels properties, and also for attaining good lubes properties. A non-exclusive list of such publications includes, for example, U.S. Pat. Nos. 5,282,958, 5,953,414, 6,413,412, 6,652,735, 6,723,889, 7,077,948, 7,261,805, and 7,300,900, U.S. Patent Application Publication Nos. 2003/0085154, 2004/0050753, 2004/0118744, and 2009/0166256, and European Patent Nos. 0 649 896 and 0 743 351.

Nevertheless, it would be desirable to find a process in which a higher boiling point hydrocarbon, such as a vacuum gasoil, can be hydroprocessed (hydrocracked) to allow beneficial use of the converted portion in fuels compositions and simultaneously beneficial use of the unconverted (but still treated) portion in lubricant compositions. Of particular interest are processes in which the yield of more valuable fuels, such as diesel at this point, can be maximized through higher hydrocracking conversions without sacrificing usability of the unconverted hydrocarbons for other valuable applications, such as lubricants. The processes of the present invention are detailed hereinbelow.

SUMMARY OF THE INVENTION

One aspect of this invention relates to a process for hydroprocessing a heavy feed, such as a vacuum gasoil (VGO) feed, that can be selective for distillate boiling range converted products and yielding unconverted products useful as lubricants. Such an inventive process can comprise: (a) hydrotreating a vacuum gasoil feedstream having a sulfur content of at least about 1000 wppm and a nitrogen content of at least about 200 wppm with a hydrogen-containing treat gas stream in the presence of a hydrotreating catalyst under effective hydrotreating conditions to form a hydrotreated product; (b) hydrocracking the hydrotreated product in a first hydrocracking stage with a hydrogen-containing treat gas stream in the presence of a first hydrocracking catalyst system under effective hydrocracking conditions sufficient to attain a conversion level of not more than 50%, so as to form a first hydrocracked, hydrotreated product; (c) separating the first hydrocracked, hydrotreated product into a first converted product having a boiling range maximum of about 700° F. (about 371° C.) and a first unconverted product having a boiling range minimum of about 700° F. (about 371° C.), the first converted product having one or more of a cetane number of at least 40 (for example, at least 45), a smoke point of at least 19 mm, and a sulfur content of not greater than 20 wppm, the first unconverted product having a nitrogen content of not greater than about 50 wppm and a sulfur content of not greater than about 300 wppm; (d) hydrocracking the first unconverted product in a second hydrocracking stage with a hydrogen-containing treat gas stream in the presence of a two-stage hydrocracking catalyst system under effective hydrocracking conditions sufficient to attain a conversion level of greater than 55%, so as to form a second hydrotreated, hydrocracked product; and (e) separating the second hydrotreated, hydrocracked product into a second converted product having a boiling range maximum of about 700° F. (about 371° C.) and a second unconverted product having a boiling range minimum of about 700° F. (about 371° C.), the second converted product having one or more of a cetane number of at least 40 (for example, at least 45), a smoke point of at least 19 mm (for example at least 20 mm), and a sulfur content of not greater than 20 wppm (for example, not greater than 12 wppm), the second unconverted product having one or more of a viscosity index of at least 80, a pour point of less than 5° C. (for example, less than 0° C.), and a kinematic viscosity at about 100° C. of at least 1 cSt (for example, at least 1.5 cSt). Advantageously, the two-stage hydrocracking catalyst system can comprise (i) a USY catalyst containing platinum and/or palladium and (ii) a ZSM-48 catalyst containing platinum and/or palladium.

Another aspect of this invention relates more broadly to a process for hydroprocessing a heavy feed, such as a vacuum gasoil (VGO) feed, that can be selective for distillate boiling range converted products and yielding unconverted products useful as lubricants. Such an inventive process can comprise: (i) providing a vacuum gasoil feedstream having a nitrogen content of not greater than about 50 wppm and a sulfur content of not greater than about 300 wppm; (ii) hydrocracking the vacuum gasoil feedstream in a high-conversion hydrocracking stage with a hydrogen-containing treat gas stream in the presence of a two-stage catalyst system under effective hydrocracking conditions sufficient to attain a conversion level of greater than 55%, so as to form a hydrocracked product; and (iii) separating the hydrocracked product into a converted product having a boiling range maximum of about 700° F. (about 371° C.) and an unconverted product having a boiling range minimum of about 700° F. (about 371° C.), the converted product having one or more of a cetane number of at least 40 (for example at least 45), a smoke point of at least 19 mm (for example, at least 20 mm), and a sulfur content of not greater than 20 wppm (for example, not greater than 12 wppm), the unconverted product having one or more of a viscosity index of at least 80, a pour point of less than 5° C. (for example less than 0° C.), and a kinematic viscosity at about 100° C. of at least 1 cSt (for example, at least 1.5 cSt). Again advantageously, the two-stage catalyst system can comprise (i) a USY catalyst containing platinum and/or palladium and (ii) a ZSM-48 catalyst containing platinum and/or palladium.

In this latter aspect of the invention, the vacuum gasoil feedstream according to step (i) can typically have a nitrogen content of not greater than about 50 wppm and a sulfur content of not greater than about 300 wppm can be a virgin crude oil portion or a previously treated crude oil portion. In one embodiment, the vacuum gasoil feedstream according to step (i) can be formed by: (p) hydrotreating a crude oil portion having a sulfur content of at least about 1000 wppm and a nitrogen content of at least about 200 wppm with a hydrogen-containing treat gas stream in the presence of a hydrotreating catalyst under effective hydrotreating conditions to form a hydrotreated product; (q) hydrocracking the hydrotreated product in a preliminary hydrocracking stage with a hydrogen-containing treat gas stream in the presence of a preliminary hydrocracking catalyst system under effective preliminary hydrocracking conditions sufficient to attain a conversion level of not more than 50%, so as to form a preliminary hydrocracked, hydrotreated product; and (r) separating the preliminary hydrocracked, hydrotreated product into a preliminary converted product having a boiling range maximum of about 700° F. (about 371° C.) and a preliminary unconverted product having a boiling range minimum of about 700° F. (about 371° C.). In such an embodiment, the preliminary unconverted product from step (r) can thus constitute the vacuum gasoil feedstream of step (i), as is analogous to the first unconverted product in step (c) being used as the feedstream to the second hydrocracking process in step (d).

In either aspect of the invention, the high-conversion hydrocracking stage can be the second hydrocracking stage, and such hydrocracking stages are described interchangeably herein, as are the first and preliminary hydrocracking stages.

DETAILED DESCRIPTION OF THE EMBODIMENTS

Advantageously, the feedstream entering the high-conversion hydrocracking stage or the second hydrocracking stage, whether that be the first unconverted product or the vacuum gasoil feedstream in the various aspects of the invention, can have a nitrogen content of not greater than about 50 wppm (for example not greater than about 40 wppm, not greater than about 30 wppm, not greater than about 25 wppm, not greater than about 20 wppm, not greater than about 15 wppm, or not greater than about 10 wppm) and/or a sulfur content of not greater than about 250 wppm (for example, not greater than about 200 wppm, not greater than about 150 wppm, not greater than about 125 wppm, not greater than about 100 wppm, not greater than about 75 wppm, not greater than about 50 wppm, or not greater than about 30 wppm).

Additionally or alternately, the hydrocracking conditions in the high-conversion/second hydrocracking stage can be sufficient to attain a conversion level of at least about 60%, for example at least about 65%, at least about 70%, at least about 75%, at least about 80%, at least about 85%, or at least about 90%. Further additionally or alternately, the hydrocracking conditions in the high-conversion/second hydrocracking stage can be sufficient to attain a conversion level of not more than about 99%, for example not more than about 97%, not more than about 95%, not more than about 90%, not more than about 85%, not more than about 80%, or not more than about 75%. Still further additionally or alternately, the hydrocracking conditions in the high-conversion/second hydrocracking stage can be sufficient to attain a conversion level from about 55% to about 99%, for example from about 55% to about 75%, from about 60% to about 95%, or from about 60% to about 80%. As used herein, the term "conversion level," with reference to a feedstream being hydrocracked, means the relative amount of change in boiling point of the individual molecules in the feedstream from above 700° F. (371° C.) to 700° F. (371° C.) or below. Conversion level can be measured by any appropriate means and, for a feedstream whose minimum boiling point is at least 700.1° F. (371.2° C.), can represent the average proportion of material that has passed through the hydrocracking process and has a boiling point less than or equal to 700.0° F. (371.1° C.), compared to the total amount of hydrocracked material.

Additionally or alternately, the converted product from the high-conversion/second hydrocracking stage can exhibit a cetane number of at least 45, for example at least 50 or at least 51, and/or a sulfur content of not greater than 10 wppm, for example not greater than about 8 wppm, not greater than about 7 wppm, not greater than about 6 wppm, or not greater than about 5 wppm. Cetane number can be measured according to any appropriate measurement, e.g., ASTM D613.

Additionally or alternately, the unconverted product from the high-conversion/second hydrocracking stage can exhibit a viscosity index of at least 80, for example at least 90, at least 95, at least 100, at least 105, at least 110, at least 115, at least 120, at least 125, at least 130, at least 135, or at least 140. Further additionally or alternately, the unconverted product from the second/high-conversion hydrocracking stage can exhibit a viscosity index of not greater than 175, for example not greater than 165, not greater than 160, not greater than 155, not greater than 150, not greater than 145, not greater than 140, not greater than 135, not greater than 130, not greater than 125, or not greater than 120. Yet further additionally or alternately, the unconverted product from the second/high-conversion hydrocracking stage can exhibit a viscosity index between 80 and 140, for example between 80 and 120, between 95 and 140, or between 95 and 120.

Additionally or alternately, the unconverted product from the high-conversion/second hydrocracking stage can exhibit a pour point of less than 5° C., for example less than 0° C., less than −5° C., less than −10° C., or less than −15° C. Further additionally or alternately, the unconverted product from the second/high-conversion hydrocracking stage may exhibit a pour point of greater than −55° C., for example greater than −50° C., greater than −45° C., greater than −40° C., greater than −35° C., greater than −30° C., greater than −25° C., or greater than −20° C.

Additionally or alternately, the unconverted product from the high-conversion/second hydrocracking stage can exhibit a kinematic viscosity at about 100° C. of at least 1 cSt, for example at least 1.5 cSt, at least 2 cSt, at least 3 cSt, at least 4 cSt, at least 5 cSt, at least 6 cSt, at least 7 cSt, or at least 8 cSt. Further additionally or alternately, the unconverted product from the second/high-conversion hydrocracking stage can exhibit a kinematic viscosity at about 100° C. of not more than 15 cSt, for example not more than 12 cSt, not more than 10 cSt, not more than 9 cSt, not more than 8 cSt, not more than 7 cSt, not more than 6 cSt, not more than 5 cSt, or not more than 4 cSt.

Additionally or alternately, the two-stage catalyst system of the high-conversion/second hydrocracking stage can comprise, consist essentially of, or consist of a mixture of a USY catalyst loaded with from about 0.1 wt % to about 3.0 wt % (for example from about 0.2 wt % to about 2.0 wt %, from about 0.3 wt % to about 1.5 wt %, or from about 0.3 wt % to about 1.0 wt %) platinum, based on the weight of the USY catalyst, and a ZSM-48 catalyst loaded with from about 0.1 wt % to about 3.0 wt % (for example from about 0.2 wt % to about 2.0 wt %, from about 0.3 wt % to about 1.5 wt %, or from about 0.3 wt % to about 1.0 wt %) platinum, based on the weight of the ZSM-48 catalyst.

Additionally or alternately, the catalyst mixture in the two-stage catalyst system of the high-conversion/second hydrocracking stage can comprise a volume ratio of USY catalyst to ZSM-48 catalyst from about 1:9 to about 9:1, for example from about 1:7 to about 7:1, from about 1:5 to about 5:1, from about 1:4 to about 4:1, from about 1:3 to about 3:1, from about 1:2 to about 2:1, from about 1:2 to about 9:1, from about 1:2 to about 7:1, from about 1:2 to about 5:1, from about 1:2 to about 4:1, from about 1:2 to about 3:1, from about 1:3 to about 4:1, from about 1:3 to about 5:1, from about 1:1 to about 3:1, from about 1:1 to about 4:1, or from about 1:1 to about 5:1. In the catalyst mixture in the two-stage catalyst system of the high-conversion/second hydrocracking stage, the USY catalyst and the ZSM-48 catalyst: may be effectively mixed together so that the two catalysts essentially comprise a single mixed stage; may be disposed into separate stages in which a substantially USY catalyst stage follows the substantially ZSM-48 catalyst stage, or vice versa; may be disposed into separated stages in which a USY-rich (i.e., more than 50 vol % USY) catalyst stage follows a ZSM-48-rich (i.e., more than 50 vol % ZSM-48) catalyst stage, or vice versa; may include a mixed catalyst stage in which the USY catalyst and the ZSM-48 catalyst are mixed in approximately a 50/50 ratio by volume; may be mixed and disposed in a continuous or intermittent gradient from a USY-rich catalyst stage to aZSM-48-rich catalyst stage; may comprise multiple stages that are all USY-rich or all ZSM-48-rich; or the like; or (to the extent that they are not mutually exclusive) combinations thereof.

With regard to the USY catalyst mentioned hereinabove, the unit cell size and/or the silicon-to-aluminum (Si/Al) ratio of the catalyst, prior to addition of any loaded metal(s), can be important. Advantageously, the USY catalyst can have a unit cell size of about 24.30 Å or less, for example about 24.27 Å or less or about 24.25 Å or less, and/or the USY catalyst can have an Si/Al ratio of at least about 25, for example at least about 70, at least about 90, at least about 100, at least about 110, at least about 120, or at least about 125, optionally also an Si/Al ratio of not more than about 1000, for example not more than about 750, not more than about 500, not more than about 350, not more than about 300, not more than about 250, or not more than about 200.

In an embodiment, the effective hydrocracking conditions of the high-conversion/second hydrocracking stage can comprise one or more of: a weight average bed temperature (WABT) from about 550° F. (about 288° C.) to about 800° F. (about 427° C.); a total pressure from about 300 psig (about 2.1 MPag) to about 3000 psig (about 20.7 MPag), for example from about 700 psig (about 4.8 MPag) to about 2000 psig (about 13.8 MPag); an LHSV from about 0.1 $hr^{-1}$ to about 20 $hr^{-1}$, for example from about 0.2 $hr^{-1}$ to about 10 $hr^{-1}$; and a hydrogen treat gas rate from about 500 scf/bbl (about 85 $Nm^3/m^3$) to about 10000 scf/bbl (about 1700 $Nm^3/m^3$), for example from about 750 scf/bbl (about 130 $Nm^3/m^3$) to about 7000 scf/bbl (about 1200 $Nm^3/m^3$) or from about 1000 scf/bbl (about 170 $Nm^3/m^3$) to about 5000 scf/bbl (about 850 $Nm^3/m^3$).

Advantageously, the distillate yield from the hydrocracking step can be desirably relatively high. For instance, the converted product from the high-conversion/second hydrocracking stage can have a yield of material boiling in the range between 350° F. (177° C.) and 700° F. (371° C.) of at least 30 wt %, for example at least 35 wt %, at least 40 wt %, or at least 45 wt %, based on the total weight of the converted product from the high-conversion/second hydrocracking stage. Additionally or alternately, the distillate yield from the hydroprocessing steps can advantageously be relatively high. For instance, the combination of the converted product from the high-conversion/second hydrocracking stage and the converted product from the preliminary/first hydrocracking stage can collectively have a yield of material boiling in the range between 350° F. (177° C.) and 700° F. (371° C.) of at least 40 wt %, for example at least 45 wt %, at least 50 wt %, at least 55 wt %, at least 60 wt %, at least 65 wt %, or at least 70 wt %, based on the combined weight of the converted products from both the preliminary/first hydrocracking and the high-conversion/second hydrocracking stages.

In embodiments of the invention in which there is a hydrotreating step, the vacuum gasoil feedstream or the crude oil portion fed into the hydrotreating step can advantageously exhibit a sulfur content of at least about 1000 wppm (for example at least about 2000 wppm, at least about 3000 wppm, at least about 4000 wppm, at least about 5000 wppm, at least about 7500 wppm, at least about 10000 wppm, at least about 15000 wppm, at least about 20000 wppm, at least about 25000 wppm, at least about 30000 wppm, at least about 35000 wppm, or at least about 40000 wppm) and/or a nitrogen content of at least about 200 wppm (for example at least about 300 wppm, at least about 400 wppm, at least about 500 wppm, at least about 750 wppm, at least about 1000 wppm, at least about 1500 wppm, at least about 2000 wppm, at least about 2500 wppm, at least about 3000 wppm, at least about 4000 wppm, at least about 5000 wppm, or at least about 6000 wppm).

In embodiments of the invention in which there is a hydrotreating step, the hydrotreating catalyst can comprise any suitable hydrotreating catalyst, e.g., a catalyst comprising at least one Group VIII metal (for example selected from Ni, Co, and a combination thereof) and at least one Group VIB metal (for example selected from Mo, W, and a combination thereof), optionally including a suitable support and/or filler material (e.g., comprising alumina, silica, titania, zirconia, or a combination thereof). The hydrotreating catalyst according to aspects of this invention can be a bulk catalyst or a supported catalyst. Techniques for producing supported catalysts are well known in the art. Techniques for producing bulk metal catalyst particles are known and have been previously described, for example in U.S. Pat. No. 6,162,350, which is hereby incorporated by reference. Bulk metal catalyst particles can be made via methods where all of the metal catalyst precursors are in solution, or via methods where at least one of the precursors is in at least partly in solid form, optionally but preferably while at least another one of the precursors is provided only in a solution form. Providing a metal precursor at least partly in solid form can be achieved, for example, by providing a solution of the metal precursor that also includes solid and/or precipitated metal in the solution, such as in the form of suspended particles. By way of illustration, some examples of suitable hydrotreating catalysts are described in one or more of U.S. Pat. Nos. 6,156,695, 6,162,350, 6,299,760, 6,582,590, 6,712,955, 6,783,663, 6,863,803, 6,929,738, 7,229,548, 7,288,182, 7,410,924, and 7,544,632, U.S. Patent Application Publication Nos. 2005/0277545, 2006/0060502, 2007/0084754, and 2008/0132407, and International Publication Nos. WO 04/007646, WO 2007/084437, WO 2007/084438, WO 2007/084439, and WO 2007/084471, inter alia.

In some embodiments of the invention in which there is a hydrotreating step, the hydrotreating conditions can comprise one or more of: a weight average bed temperature (WABT) from about 550° F. (about 288° C.) to about 800° F. (about 427° C.); a total pressure from about 300 psig (about 2.1 MPag) to about 3000 psig (about 20.7 MPag), for example from about 700 psig (about 4.8 MPag) to about 2000 psig (about 13.8 MPag); an LHSV from about 0.1 $hr^{-1}$ to about 20 $hr^{-1}$, for example from about 0.2 $hr^{-1}$ to about 10 $hr^{-1}$; and a hydrogen treat gas rate from about 500 scf/bbl (about 85 $Nm^3/m^3$) to about 10000 scf/bbl (about 1700 $Nm^3/m^3$), for example from about 750 scf/bbl (about 130 $Nm^3/m^3$) to about 7000 scf/bbl (about 1200 $Nm^3/m^3$) or from about 1000 scf/bbl (about 170 $Nm^3/m^3$) to about 5000 scf/bbl (about 850 $Nm^3/m^3$).

In embodiments of the invention in which there is a preliminary/first hydrocracking step, the preliminary/first hydrocracking catalyst can comprise any suitable or standard hydrocracking catalyst, for example, a zeolitic base selected from zeolite Beta, zeolite X, zeolite Y, faujasite, ultrastable Y (USY), dealuminized Y (Deal Y), Mordenite, ZSM-3, ZSM-4, ZSM-18, ZSM-20, ZSM-48, and combinations thereof, which base can advantageously be loaded with one or more active metals (e.g., either (i) a Group VIII noble metal such as platinum and/or palladium or (ii) a Group VIII non-noble metal such nickel, cobalt, iron, and combinations thereof, and a Group VIB metal such as molybdenum and/or tungsten).

In embodiments of the invention in which there is a preliminary/first hydrocracking step, the preliminary/first hydrocracking conditions can typically be sufficient to attain a relatively low conversion level, e.g., less than 55%, less than 50%, less than 45%, less than 40%, from about 5% to about 50%, from about 5% to about 45%, from about 5% to about 40%, from about 10% to about 50%, from about 10% to about 45%, from about 10% to about 40%, from about 15% to about 50%, from about 15% to about 45%, from about 15% to about 40%, from about 20% to about 50%, from about 20% to about 45%, from about 20% to about 40%, from about 25% to about 50%, from about 25% to about 45%, from about 25% to about 40%, from about 30% to about 50%, or from about 30% to about 45%. Conversion level in the preliminary/first hydrocracking stage is defined herein similarly as in the high-conversion/secondary hydrocracking stage.

In embodiments of the invention in which there is a preliminary/first hydrocracking step, each of the effective hydrocracking conditions of the preliminary/first hydrocracking stage can be similar to or different from the corresponding condition in the high-conversion/second hydrocracking step. Additionally or alternately in embodiments of the invention in which there is a preliminary/first hydrocracking step, the effective hydrocracking conditions of the preliminary/first hydrocracking stage can comprise one or more of: a weight average bed temperature (WABT) from about 550° F. (about 288° C.) to about 800° F. (about 427° C.); a total pressure from about 300 psig (about 2.1 MPag) to about 3000 psig (about 20.7 MPag), for example from about 700 psig (about 4.8 MPag) to about 2000 psig (about 13.8 MPag); an LHSV from about 0.1 $hr^{-1}$ to about 20 $hr^{-1}$, for example from about 0.2 $hr^{-1}$ to about 10 $hr^{-1}$; and a hydrogen treat gas rate from about 500 scf/bbl (about 85 $Nm^3/m^3$) to about 10000 scf/bbl (about 1700 $Nm^3/m^3$), for example from about 750 scf/bbl (about 130 $Nm^3/m^3$) to about 7000 scf/bbl (about 1200 $Nm^3/m^3$) or from about 1000 scf/bbl (about 170 $Nm^3/m^3$) to about 5000 scf/bbl (about 850 $Nm^3/m^3$).

The converted products from the hydrocracking stages detailed herein are described as having a boiling range maximum of about 700° F. (about 371° C.) and thus contain distillate portions described herein as constituting material having a boiling range between 350° F. (177° C.) and 700° F. (371° C.) (at least in describing distillate yield). The basic test method of determining the boiling points or ranges of such feedstock, as well as the fuel compositions produced according to this invention, can be by performing batch distillation according to ASTM D86-09e1, Standard Test Method for Distillation of Petroleum Products at Atmospheric Pressure.

Treat gas, as referred to herein, can be either pure hydrogen or a hydrogen-containing gas, which contains hydrogen in an amount at least sufficient for the intended reaction purpose(s), optionally in addition to one or more other gases (e.g., nitrogen, light hydrocarbons such as methane, and the like, and combinations thereof) that generally do not adversely interfere with or affect either the reactions or the products. Impurities, such as $H_2S$ and $NH_3$, are typically undesirable and would typically be removed from, or reduced to desirably low levels in, the treat gas before it is conducted to the reactor stage(s). The treat gas stream introduced into a reaction stage can preferably contain at least about 50 vol %, for example at least about 75 vol %, hydrogen.

The catalysts in any of the hydroprocessing stages according to the processes of the invention may optionally contain additional components, such as other transition metals (e.g., Group V metals such as niobium), rare earth metals, organic ligands (e.g., as added or as precursors left over from oxidation and/or sulfidization steps), phosphorus compounds, boron compounds, fluorine-containing compounds, silicon-containing compounds, promoters, binders, fillers, or like agents, or combinations thereof. The Groups referred to herein refer to Groups of the CAS Version as found in the Periodic Table of the Elements in Hawley's Condensed Chemical Dictionary, $13^{th}$ Edition.

In some embodiments, the distillate portions of the converted products can advantageously be used as one or more transportation fuel compositions and/or may be sent to one or more existing fuel pools. Non-limiting examples of such fuel compositions/pools can include, but are note limited to, diesel, kerosene, jet, heating oil, marine, and/or bunker fuels. For instance, in one embodiment, the distillate portions of the converted products can be split (e.g., by fractionation or the like) into a kerosene cut having a boiling range between 400° F. (204° C.) and 550° F. (288° C.) and a diesel cut having a boiling range between 550° F. (232° C.) and 700° F. (371° C.). In such embodiments where the distillate portions of the converted products are split by boiling range into a kerosene cut and a diesel cut, the smoke point of the (distillate portions of the) unconverted products should be understood to refer only to the kerosene cut, the cloud point of the (distillate portions of the) unconverted products should be understood to refer only to the diesel cut, and the sulfur content, nitrogen content, and cetane number should be understood to refer collectively to the combined kerosene and diesel cuts.

The feedstock provided to any of the hydroprocessing processes according to the invention can, in some embodiments, comprise both a biofeed (lipid material) portion and a mineral oil portion. By "mineral oil" is meant a fossil/mineral fuel source, such as crude oil, and not the commercial organic product, such as sold under the CAS number 8020-83-5, e.g., by Aldrich. In one embodiment, the lipid material and mineral oil can be mixed together prior to any hydroprocessing step. In another embodiment, the lipid material and mineral oil can be provided as separate streams into an appropriate processing unit or vessel.

The term "lipid material" as used according to the invention is a composition comprised of biological materials. Generally, these biological materials include vegetable fats/oils, animal fats/oils, fish oils, pyrolysis oils, and algae lipids/oils, as well as components of such materials. More specifically, the lipid material includes one or more type of lipid compounds. Lipid compounds are typically biological compounds that are insoluble in water, but soluble in non-polar (or fat) solvents. Non-limiting examples of such solvents include alcohols, ethers, chloroform, alkyl acetates, benzene, and combinations thereof.

Major classes of lipids include, but are not necessarily limited to, fatty acids, glycerol-derived lipids (including fats, oils and phospholipids), sphingosine-derived lipids (including ceramides, cerebrosides, gangliosides, and sphingomyelins), steroids and their derivatives, terpenes and their derivatives, fat-soluble vitamins, certain aromatic compounds, and long-chain alcohols and waxes.

In living organisms, lipids generally serve as the basis for cell membranes and as a form of fuel storage. Lipids can also be found conjugated with proteins or carbohydrates, such as in the form of lipoproteins and lipopolysaccharides.

Examples of vegetable oils that can be used in accordance with this invention include, but are not limited to rapeseed (canola) oil, soybean oil, coconut oil, sunflower oil, palm oil, palm kernel oil, peanut oil, linseed oil, tall oil, corn oil, castor oil, jatropha oil, jojoba oil, olive oil, flaxseed oil, camelina oil, safflower oil, babassu oil, tallow oil and rice bran oil.

Vegetable oils as referred to herein can also include processed vegetable oil material. Non-limiting examples of processed vegetable oil material include fatty acids and fatty acid alkyl esters. Alkyl esters typically include $C_1$-$C_5$ alkyl esters. One or more of methyl, ethyl, and propyl esters are preferred.

Examples of animal fats that can be used in accordance with the invention include, but are not limited to, beef fat (tallow), hog fat (lard), turkey fat, fish fat/oil, and chicken fat. The animal fats can be obtained from any suitable source including restaurants and meat production facilities.

Animal fats as referred to herein also include processed animal fat material. Non-limiting examples of processed animal fat material include fatty acids and fatty acid alkyl esters. Alkyl esters typically include $C_1$-$C_5$ alkyl esters. One or more of methyl, ethyl, and propyl esters are preferred.

Algae oils or lipids are typically contained in algae in the form of membrane components, storage products, and metabolites. Certain algal strains, particularly microalgae such as diatoms and cyanobacteria, contain proportionally high levels of lipids. Algal sources for the algae oils can contain varying amounts, e.g., from 2 wt % to 40 wt % of lipids, based on total weight of the biomass itself.

Algal sources for algae oils include, but are not limited to, unicellular and multicellular algae. Examples of such algae include a rhodophyte, chlorophyte, heterokontophyte, tribophyte, glaucophyte, chlorarachniophyte, euglenoid, haptophyte, cryptomonad, dinoflagellum, phytoplankton, and the like, and combinations thereof. In one embodiment, algae can be of the classes Chlorophyceae and/or Haptophyta. Specific species can include, but are not limited to, *Neochloris oleoabundans, Scenedesmus dimorphus, Euglena gracilis, Phaeodactylum tricornutum, Pleurochrysis camerae, Prymnesium parvum, Tetraselmis chui*, and *Chlamydomonas reinhardtii.*

The lipid material portion of the feedstock, when present, can be comprised of triglycerides, fatty acid alkyl esters, or preferably combinations thereof. In one embodiment where lipid material is present, the feedstock can include at least 0.05 wt % lipid material, based on total weight of the feedstock provided for processing into fuel, preferably at least 0.5 wt %, for example at least 1 wt %, at least 2 wt %, or at least 4 wt %. Additionally or alternately where lipid material is present, the feedstock can include not more than 40 wt % lipid material, based on total weight of the feedstock, preferably not more than 30 wt %, for example not more than 20 wt % or not more than 10 wt %.

In embodiments where lipid material is present, the feedstock can include not greater than 99.9 wt % mineral oil, for example not greater than 99.8 wt %, not greater than 99.7 wt %, not greater than 99.5 wt %, not greater than 99 wt %, not greater than 98 wt %, not greater than 97 wt %, not greater than 95 wt %, not greater than 90 wt %, not greater than 85 wt % mineral oil, or not greater than 80 wt %, based on total weight of the feedstock. Additionally or alternately in embodiments where lipid material is present, the feedstock can include at least 50 wt % mineral oil, for example at least 60 wt %, at least 70 wt %, at least 75 wt %, or at least 80 wt % mineral oil, based on total weight of the feedstock.

In some embodiments where lipid material is present, the lipid material can comprise a fatty acid alkyl ester. Preferably, the fatty acid alkyl ester comprises fatty acid methyl esters (FAME), fatty acid ethyl esters (FAEE), and/or fatty acid propyl esters.

Any type of reactor suitable for hydrocracking can be used to carry out the any of the hydrocracking stages in the processes according to the invention. Examples of such reactors can include, but are not limited to, trickle bed, ebullating bed, moving bed, fluidized bed, and slurry reactors.

Additionally or alternately, the present invention can include the following embodiments.

Embodiment 1. A hydrocracking process on a vacuum gasoil feedstream being selective for distillate boiling range converted products and yielding unconverted products useful as lubricants, which process comprises: providing a vacuum gasoil feedstream having a nitrogen content of not greater than about 50 wppm and a sulfur content of not greater than about 300 wppm; hydrocracking the vacuum gasoil feedstream in a high-conversion hydrocracking stage with a hydrogen-containing treat gas stream in the presence of a two-stage catalyst system under effective hydrocracking conditions sufficient to attain a conversion level of greater than 55%, so as to form a hydrocracked product; and separating the hydrocracked product into a converted product having a boiling range maximum of about 700° F. (about 371° C.) and an unconverted product having a boiling range minimum of about 700° F. (about 371° C.), the converted product having one or more of a cetane number of at least 45, a smoke point of at least 20 mm, and a sulfur content of not greater than 12 wppm, the unconverted product having one or more of a viscosity index of at least 80, a pour point of less than 5° C., and a kinematic viscosity at about 100° C. of at least 1 cSt, wherein the two-stage catalyst system comprises (i) a USY catalyst containing platinum and/or palladium and (ii) a ZSM-48 catalyst containing platinum and/or palladium.

Embodiment 2. The process of embodiment 1, wherein the vacuum gasoil feedstream having a nitrogen content of not greater than about 50 wppm and a sulfur content of not greater than about 300 wppm is formed by: hydrotreating a crude oil portion having a sulfur content of at least about 1000 wppm and a nitrogen content of at least about 200 wppm with a hydrogen-containing treat gas stream in the presence of a hydrotreating catalyst under effective hydrotreating conditions to form a hydrotreated product; hydrocracking the hydrotreated product in a preliminary hydrocracking stage with a hydrogen-containing treat gas stream in the presence of a preliminary hydrocracking catalyst system under effective preliminary hydrocracking conditions sufficient to attain a conversion level of not more than 50%, so as to form a preliminary hydrocracked, hydrotreated product; and separating the preliminary hydrocracked, hydrotreated product into a preliminary converted product having a boiling range maximum of about 700° F. (about 371° C.) and a preliminary unconverted product having a boiling range minimum of about 700° F. (about 371° C.), such that the preliminary unconverted product is the vacuum gasoil feedstream.

Embodiment 3. The process of any one of the previous embodiments, wherein the hydrocracking conditions in the high-conversion hydrocracking stage are sufficient to attain a conversion level from about 60% to about 95%.

Embodiment 4. The process of any one of the previous embodiments, wherein the converted product from the high-conversion hydrocracking stage exhibits a cetane number of at least 51 and a sulfur content of not greater than 10 wppm.

Embodiment 5. The process of any one of the previous embodiments, wherein the unconverted product from the high-conversion hydrocracking stage exhibits a viscosity index between 80 and 140 and/or wherein the unconverted product from the high-conversion hydrocracking stage exhibits a pour point of less than −10° C. and a kinematic viscosity at about 100° C. of at least 2 cSt.

Embodiment 6. The process of any one of the previous embodiments, wherein the two-stage catalyst system of the high-conversion hydrocracking stage consists essentially of a mixture of a USY catalyst loaded with from about 0.1 wt % to about 3.0 wt % platinum, based on the weight of the USY catalyst, and a ZSM-48 catalyst loaded with from about 0.1 wt % to about 3.0 wt % platinum, based on the weight of the ZSM-48 catalyst.

Embodiment 7. The process of claim 1, wherein the vacuum gasoil feedstream has a nitrogen content of not greater than about 20 wppm and a sulfur content of not greater than about 150 wppm.

Embodiment 8. The process of any one of the previous embodiments, wherein the effective hydrocracking conditions of the high-conversion hydrocracking stage comprise a weight average bed temperature from about 550° F. (about 288° C.) to about 800° F. (about 427° C.), a total pressure from about 700 psig (about 4.8 MPag) to about 2000 psig (about 13.8 MPag), an LHSV from about 0.1 $hr^{-1}$ to about 20 $hr^{-1}$, and a hydrogen treat gas rate from about 500 scf/bbl (about 85 $Nm^3/m^3$) to about 10000 scf/bbl (about 1700 $Nm^3/m^3$).

Embodiment 9. The process of any one of the previous embodiments, wherein the converted product from the high-conversion hydrocracking stage has a yield of material boiling in the range between 350° F. (177° C.) and 700° F. (371° C.) of at least 35 wt %, based on the total weight of the converted product from the high-conversion hydrocracking stage.

Embodiment 10. The process of any one of embodiments 2-9, wherein the crude oil portion exhibits a sulfur content of at least about 10000 wppm and a nitrogen content of at least about 1000 wppm.

Embodiment 11. The process of any one of embodiments 2-10, wherein the hydrotreating catalyst comprises at least one Group VIII metal selected from Ni, Co, and a combination thereof and at least one Group VIB metal selected from Mo, W, and a combination thereof, optionally including a support comprising alumina, silica, titania, zirconia, or a combination thereof, and/or wherein the hydrotreating conditions comprise a weight average bed temperature from about 550° F. (about 288° C.) to about 800° F. (about 427° C.), a total pressure from about 300 psig (about 2.1 MPag) to about 3000 psig (about 20.7 MPag), an LHSV from about 0.1 $hr^{-1}$ to about 20 $hr^{-1}$, and a hydrogen treat gas rate from about 500 scf/bbl (about 85 $Nm^3/m^3$) to about 10000 scf/bbl (about 1700 $Nm^3/m^3$).

Embodiment 12. The process of any one of embodiments 2-11, wherein the preliminary hydrocracking catalyst comprises a zeolitic base selected from zeolite Beta, zeolite X, zeolite Y, faujasite, ultrastable Y, dealuminized Y, Mordenite, ZSM-3, ZSM-4, ZSM-18, ZSM-20, ZSM-48, and combinations thereof, which base is loaded with either (i) a Group VIII noble metal selected from platinum and/or palladium or (ii) a Group VIII non-noble metal selected from nickel, cobalt, iron, and combinations thereof, and a Group VIB metal selected from molybdenum and/or tungsten.

Embodiment 13. The process of any one of embodiments 2-12, wherein the effective hydrocracking conditions in the preliminary hydrocracking stage are sufficient to attain a conversion level from about 10% to about 45% and/or comprise a weight average bed temperature from about 550° F. (about 288° C.) to about 800° F. (about 427° C.), a total pressure from about 700 psig (about 4.8 MPag) to about 2000 psig (about 13.8 MPag), an LHSV from about 0.1 $hr^{-1}$ to about 20 $hr^{-1}$, and a hydrogen treat gas rate from about 500 scf/bbl (about 85 $Nm^3/m^3$) to about 10000 scf/bbl (about 1700 $Nm^3/m^3$).

Embodiment 14. The process of any one of embodiments 2-13, wherein the combination of the converted product from the high-conversion hydrocracking stage and the converted product from the preliminary hydrocracking stage collectively has a yield of material boiling in the range between 350° F. (177° C.) and 700° F. (371° C.) of at least 50 wt %, based on the combined weight of the converted products from both the preliminary hydrocracking stage and the high-conversion hydrocracking stage.

Embodiment 15. A hydroprocessing process that is selective for distillate boiling range converted products and yielding unconverted products useful as lubricants, which process comprises: hydrotreating a vacuum gasoil feedstream having a sulfur content of at least about 1000 wppm and a nitrogen content of at least about 200 wppm with a hydrogen-containing treat gas stream in the presence of a hydrotreating catalyst under effective hydrotreating conditions to form a hydrotreated product; hydrocracking the hydrotreated product in a first hydrocracking stage with a hydrogen-containing treat gas stream in the presence of a first hydrocracking catalyst system under effective hydrocracking conditions sufficient to attain a conversion level of not more than 50%, so as to form a first hydrocracked, hydrotreated product; separating the first hydrocracked, hydrotreated product into a first converted product having a boiling range maximum of about 700° F. (about 371° C.) and a first unconverted product having a boiling range minimum of about 700° F. (about 371° C.), the first converted product having one or more of a cetane number of at least 40, a smoke point of at least 19 mm, and a sulfur content of not greater than 20 wppm, the first unconverted product having a nitrogen content of not greater than about 50 wppm and a sulfur content of not greater than about 300 wppm; hydrocracking the first unconverted product in a second hydrocracking stage with a hydrogen-containing treat gas stream in the presence of a two-stage hydrocracking catalyst system under effective hydrocracking conditions sufficient to attain a conversion level of greater than 55%, so as to form a second hydrotreated, hydrocracked product; and separating the second hydrotreated, hydrocracked product into a second converted product having a boiling range maximum of about 700° F. (about 371° C.) and a second unconverted product having a boiling range minimum of about 700° F. (about 371° C.), the second converted product having one or more of a cetane number of at least 45, a smoke point of at least 20 mm, and a sulfur content of not greater than 12 wppm, the second unconverted product having one or more of a viscosity index of at least 80, a pour point of less than 5° C., and a kinematic viscosity at about 100° C. of at least 1 cSt, wherein the two-stage hydrocracking catalyst system comprises (i) a USY catalyst containing platinum and/or palladium and (ii) a ZSM-48 catalyst containing platinum and/or palladium, and optionally wherein one or more of the following are satisfied: (a) the vacuum gasoil feedstream exhibits a sulfur content of at least about 10000 wppm and a nitrogen content of at least about 1000 wppm; (b) the hydrotreating catalyst comprises at least one Group VIII metal selected from Ni, Co, and a combination thereof and at least one Group VIB metal selected from Mo, W, and a combination thereof, optionally including a support comprising alumina, silica, titania, zirconia, or a combination thereof; (c) the hydrotreating conditions comprise a weight average bed temperature from about 550° F. (about 288° C.) to about 800° F. (about 427° C.), a total pressure from about 300 psig (about 2.1 MPag) to about 3000 psig (about 20.7 MPag), an LHSV from about 0.1 $hr^{-1}$ to about 20 $hr^{-1}$, and a hydrogen treat gas rate from about 500 scf/bbl (about 85 $Nm^3/m^3$) to about 10000 scf/bbl (about 1700 $Nm^3/m^3$); (d) the first hydrocracking catalyst comprises a zeolitic base selected from zeolite Beta, zeolite X, zeolite Y, faujasite, ultrastable Y, dealuminized Y, Mordenite, ZSM-3, ZSM-4, ZSM-18, ZSM-20, ZSM-48, and combinations thereof, which base is loaded with either (i) a Group VIII noble metal selected from platinum and/or palladium or (ii) a Group VIII non-noble metal selected from nickel, cobalt, iron, and combinations thereof, and a Group VIB metal selected from molybdenum and/or tungsten; (e) the hydrocracking conditions in the first hydrocracking stage are sufficient to attain a conversion level from about 10% to about 45%; (f) the effective hydrocracking conditions of the preliminary hydrocracking stage comprise a weight average bed temperature from about 550° F. (about 288° C.) to about 800° F. (about 427° C.), a total pressure from about 700 psig (about 4.8 MPag) to about 2000 psig (about 13.8 MPag), an LHSV from about 0.1 $hr^{-1}$ to about 20 $hr^{-1}$, and a hydrogen treat gas rate from about 500 scf/bbl (about 85 $Nm^3/m^3$) to about 10000 scf/bbl (about 1700 $Nm^3/m^3$); (g) the first unconverted product has a nitrogen content of not greater than about 20 wppm and a sulfur content of not greater than about 150 wppm; (h) the hydrocracking conditions in the second hydrocracking stage are sufficient to attain a conversion level from about 60% to about 95%; (i) the converted product from the second hydrocracking stage exhibits a cetane number of at least 51 and a sulfur content of not greater than 10 wppm; (j) the unconverted product from the second hydrocracking stage exhibits a viscosity index between 80 and 140; (k) the unconverted product from the second hydrocracking stage exhibits a pour point of less than −10° C., and a kinematic viscosity at about 100° C. of at least 2 cSt; (l) the two-stage catalyst system of the second hydrocracking stage consists essentially of a mixture of a USY catalyst loaded with from about 0.1 wt % to about 3.0 wt % platinum, based on the weight of the USY catalyst, and a ZSM-48 catalyst loaded with from about 0.1 wt % to about 3.0 wt % platinum, based on the weight of the ZSM-48 catalyst; (m) the effective hydrocracking conditions of the second hydrocracking stage comprise a weight average bed temperature from about 550° F. (about 288° C.) to about 800° F. (about 427° C.), a total pressure from about 700 psig (about 4.8 MPag) to about 2000 psig (about 13.8 MPag), an LHSV from about 0.1 $hr^{-1}$ to about 20 $hr^{-1}$, and a hydrogen treat gas rate from about 500 scf/bbl (about 85 $Nm^3/m^3$) to about 10000 scf/bbl (about 1700 $Nm^3/m^3$); (n) the converted product from the second hydrocracking stage has a yield of material boiling in the range between 350° F. (177° C.) and 700° F. (371° C.) of at least 35 wt %, based on the total weight of the converted product from the second hydrocracking stage; and (o) the combination of the converted product from the high-conversion hydrocracking stage and the converted product from the preliminary hydrocracking stage collectively has a yield of material boiling in the range between 350° F. (177° C.) and 700° F. (371° C.) of at least 50 wt %, based on the combined weight of the converted products from both the preliminary hydrocracking stage and the high-conversion hydrocracking stage.

EXAMPLES

Example 1

In Example 1, a vacuum gasoil was provided to a two-stage unit, the first stage of which was loaded with a commercially available alumina-supported Group VIB/Group VIII (e.g., NiMo) hydrotreating catalyst and the second stage of which was loaded with more of the same commercially available alumina-supported Group VIB/Group VIII (e.g., NiMo) hydrotreating catalyst, followed by a commercially available Group VIII- (e.g., Pt- and/or Pd-) loaded USY hydrocracking catalyst. The ratio of hydrotreating to hydrocracking catalyst was from about 40/60 to about 80/20, respectively. In the two-stage unit, the vacuum gasoil was both hydrotreated to remove most (e.g., at least 99% by weight, and preferably at least 99.9% by weight) of the sulfur content (e.g., hydrotreating conditions included a WABT between about 600° F. and 850° F., a total pressure from about 500 psig to about 3000 psig, a hydrogen partial pressure from about 300 psig to about 3000 psig, a hydrogen treat gas rate from about 500 scf/bbl to about 5000 scf/bbl, and an LHSV from about 0.2 $hr^{-1}$ to about 10 $hr^{-1}$) and hydrocracked at relatively low (e.g., up to about 50%) conversion conditions (e.g., approximately the same as the hydrotreating conditions hereinabove). The product from the two-stage unit was sent to a separation stage, where converted products (such as a diesel cut, a kerosene cut, and other light ends) were separated out from the remainder of the unconverted products (which still had a vacuum gasoil boiling range), which were then diverted as a hydrotreated, hydrocracked vacuum gasoil feedstream (details in Table 1 below) to a further relatively high-conversion hydrocracking stage according to the invention.

TABLE 1

| Hydrotreated, Hydrocracked VGO Feedstream | |
|---|---|
| API gravity | 33.5 |
| Sulfur, wppm | 21.4 |
| Nitrogen, wppm | 19 |
| Kinematic Viscosity @~40° C., cSt | 22.65 |
| Kinematic Viscosity @~100° C., cSt | 4.62 |
| Pour Point, ° F. (° C.) | 94 (34) |
| Distillation (ASTM D2887) | |
| T0.5, ° F. (° C.) | 561 (294) |
| T5, ° F. (° C.) | 647 (342) |
| T10, ° F. (° C.) | 685 (363) |
| T20, ° F. (° C.) | 732 (389) |
| T30, ° F. (° C.) | 766 (408) |
| T40, ° F. (° C.) | 794 (423) |
| T50, ° F. (° C.) | 819 (437) |
| T60, ° F. (° C.) | 845 (452) |
| T70, ° F. (° C.) | 871 (466) |
| T80, ° F. (° C.) | 901 (483) |
| T90, ° F. (° C.) | 941 (505) |
| T95, ° F. (° C.) | 973 (523) |
| T99.5, ° F. (° C.) | 1051 (566) |
| 2+ Ring Aromatics, mmol/kg | 335.7 |
| 3+ Ring Aromatics, mmol/kg | 169.4 |
| Total Aromatics, mmol/kg | 661.3 |
| $H_2$ Content, mass % | 13.5 |

In this second hydrocracking stage, two ~100 $cm^3$ pilot units (with no intermediate degassing) were charged with about 67 $cm^3$ of a catalyst system comprising a Pt-loaded ZSM-48 combined 1:1 by volume with a ceramic filler medium (e.g., 13/45 mesh Denstone®, commercially available from Saint-Gobain Norpro of Stow, Ohio), followed by about 133 $cm^3$ (~33 $cm^3$ in the first unit, and the remainder in the second unit) of a catalyst system comprising a Pt-loaded USY catalyst combined 1:1 by volume with a ceramic filler medium (e.g., 13/45 mesh Denstone®, commercially available from Saint-Gobain Norpro of Stow, Ohio). The first stage pilot unit was operated in an upflow condition, and the second stage pilot unit was operated in a downflow condition. Reduction/Sulfiding of the catalysts in the second hydrocracking stage, as necessary prior to contacting with the hydrotreated, hydrocracked vacuum gasoil feedstream, was/were done using hydrogen gas comprising about 400 vppm $H_2S$ at about 350° F. (about 177° C.).

The hydrotreated, hydrocracked vacuum gasoil feedstream was contacted with the catalysts in the second hydrocracking stage at a total pressure of about 1250 psig (about 8.6 MPag), an LHSV of about 1.0 $hr^{-1}$, a hydrogen treat gas rate of about 4000 scf/bbl (about 680 $Nm^3/m^3$) of ~100% $H_2$, and a temperature (WABT) ranging from about 600° F. (about 316° C.) to about 690° F. (about 366° C.). About 30-35% conversion of the feed was attained at a temperature of about 650° F. (about 343° C.); about 90% conversion of the feed was attained at a temperature of about 670° F. (about 354° C.); and about 95-97% conversion of the feed was attained at a temperature of about 690° F. (about 366° C.). Temperatures were further tweaked between about 650° F. (about 343° C.) and about 670° F. (about 354° C.) to attain approximately 65% conversion and approximately 45% conversion. Detailed analyses of the ~35%, ~65%, and ~90% conversion products are shown in Tables 2-4 below, respectively.

TABLE 2

| ~35% Conversion Case | Cut 1 (~300° F.−) | Cut 2 (300-400° F.) | Cut 3 (400-550° F.) | Cut 4 (550-700° F.) | Cut 5 (~700° F.+) |
|---|---|---|---|---|---|
| API gravity | 60.8 | 49.4 | 43.8 | 40.5 | 37.4 |
| Density@~15° C., g/cc | | | | | 0.838 |
| Sulfur, wppm | | | 1.6 | 3 | 7.1 |
| Nitrogen, wppm | | | 1 | | |
| Cloud Point, ° C. | | | | −11 | 22.7 |
| Pour Point, ° C. | | | | | |
| Smoke Point, mm | | | 21 | | |
| Cetane Number (IR) | | | 57.8 | 65.9 | 18 |
| MON (motor octane) | 61.7 | 55.3 | | | |
| RON (road octane) | 56.1 | 50.7 | | | |
| Viscosity, cSt | | | | | 5.06 |
| Kinematic Viscosity @~40° C., cSt | | | | | 24.08 |
| Kinematic Viscosity @~100° C., cSt | | | | | 4.96 |
| Viscosity Index | | | | | 134.5 |

TABLE 3

| ~65% Conversion Case | Cut 1 (~300° F.−) | Cut 2 (300-400° F.) | Cut 3 (400-550° F.) | Cut 4 (550-700° F.) | Cut 5 (~700° F.+) |
|---|---|---|---|---|---|
| API gravity | 60.2 | 50.6 | 46.1 | 42.3 | 37.2 |
| Density@~15° C., g/cc | | | | | 0.839 |
| Sulfur, wppm | | | 1 | 1 | 9.2 |
| Nitrogen, wppm | | | | | 1 |
| Cloud Point, ° C. | | | | −12.7 | 12.5 |
| Pour Point, ° C. | | | | | 5 |
| Smoke Point, mm | | | 21 | | |
| Cetane Number (IR) | | | 58.8 | 65.9 | |
| MON (motor octane) | 59.7 | 52.5 | | | |
| RON (road octane) | 54.6 | 45.8 | | | |

TABLE 3-continued

| ~65% Conversion Case | Cut 1 (~300° F.−) | Cut 2 (300-400° F.) | Cut 3 (400-550° F.) | Cut 4 (550-700° F.) | Cut 5 (~700° F.+) |
|---|---|---|---|---|---|
| Viscosity, cSt | | | | | 5.01 |
| Kinematic Viscosity @~40° C., cSt | | | | | 24.38 |
| Kinematic Viscosity @~100° C., cSt | | | | | 4.91 |
| Viscosity Index | | | | | 127.4 |

TABLE 4

| ~90% Conversion Case | Cut 1 (~300° F.−) | Cut 2 (300-400° F.) | Cut 3 (400-550° F.) | Cut 4 (550-700° F.) | Cut 5 (~700° F.+) |
|---|---|---|---|---|---|
| API gravity | 62.1 | 52.3 | 48.9 | 44.7 | 33.9 |
| Density@~15° C., g/cc | | | | | 0.856 |
| Sulfur, wppm | | | 1 | 1 | 18.5 |
| Nitrogen, wppm | | | 1 | | |
| Cloud Point, ° C. | | | | −21 | |
| Pour Point, ° C. | | | | | −37 |
| Smoke Point, mm | | | 20 | | |
| Cetane Number (IR) | | | 59.7 | 65.5 | |
| MON (motor octane) | 57.2 | 48.7 | | | |
| RON (road octane) | 53.3 | 46.5 | | | |
| Viscosity, cSt | | | | | 6.01 |
| Kinematic Viscosity @~40° C., cSt | | | | | 35.30 |
| Kinematic Viscosity @~100° C., cSt | | | | | 5.85 |
| Viscosity Index | | | | | 107.3 |

The principles and modes of operation of this invention have been described above with reference to various exemplary and preferred embodiments. As understood by those of skill in the art, the overall invention, as defined by the claims, encompasses other preferred embodiments not specifically enumerated herein.

What is claimed is:

1. A hydrocracking process on a vacuum gasoil feedstream being selective for distillate boiling range converted products and yielding unconverted products useful as lubricants, which process comprises:

providing a vacuum gasoil feedstream having a nitrogen content of not greater than about 50 wppm and a sulfur content of not greater than about 300 wppm;

hydrocracking the vacuum gasoil feedstream in a high-conversion hydrocracking stage with a hydrogen-containing treat gas stream in the presence of a two-stage catalyst system under effective hydrocracking conditions sufficient to attain a conversion level of greater than 55% relative to a conversion temperature of 700° F. (371° C.), so as to form a hydrocracked product; and separating the hydrocracked product into a converted product and an unconverted product having a higher boiling range than the converted product, the converted product having a yield of material boiling in the range between 350° F. (177° C.) and 700° F. (371° C.) of at least 35 wt %, based on a total weight of the converted product, the converted product having one or more of a cetane number of at least 45, a smoke point of at least 20 mm, and a sulfur content of not greater than 12 wppm, the unconverted product having a viscosity index of at least 105, a pour point of 5° C. or less, and a kinematic viscosity at about 100° C. of at least 1 cSt, wherein the two-stage catalyst system comprises (i) a USY catalyst containing a Group VIII noble metal selected from platinum, palladium, and combinations thereof, the USY catalyst having a unit cell size of less than 24.25 Å and a Si/Al ratio of at least 25, and (ii) a ZSM-48 catalyst containing a Group VIII noble metal selected from platinum, palladium, and combinations thereof.

2. The process of claim 1, wherein the hydrocracking conditions in the high-conversion hydrocracking stage are sufficient to attain a conversion level from about 60% to about 95%.

3. The process of claim 1, wherein the converted product from the high-conversion hydrocracking stage exhibits a cetane number of at least 51 and a sulfur content of not greater than 10 wppm.

4. The process of claim 1, wherein the unconverted product exhibits a viscosity index of 140 or less.

5. The process of claim 1, wherein the unconverted product exhibits a pour point of less than −10° C. and a kinematic viscosity at about 100° C. of at least 2 cSt.

6. The process of claim 1, wherein the two-stage catalyst system of the high-conversion hydrocracking stage consists essentially of a mixture of a USY catalyst loaded with from about 0.1 wt % to about 3.0 wt % platinum, based on the weight of the USY catalyst, and a ZSM-48 catalyst loaded with from about 0.1 wt % to about 3.0 wt % platinum, based on the weight of the ZSM-48 catalyst.

7. The process of claim 1, wherein the vacuum gasoil feedstream has a nitrogen content of not greater than about 20 wppm and a sulfur content of not greater than about 150 wppm.

8. The process of claim 1, wherein the effective hydrocracking conditions of the high-conversion hydrocracking stage comprise a weight average bed temperature from about 550° F. (about 288° C.) to about 800° F. (about 427° C.), a total pressure from about 700 psig (about 4.8 MPag) to about 2000 psig (about 13.8 MPag), an LHSV from about 0.1 $hr^{-1}$ to about 20 $hr^{-1}$, and a hydrogen treat gas rate from about 500 scf/bbl (about 85 $Nm^3/m^3$) to about 10000 scf/bbl (about 1700 $Nm^3/m^3$).

9. The process of claim 2, wherein the converted product exhibits sulfur content of not greater than 8 wppm.

10. The process of claim 9, wherein the unconverted product exhibits a viscosity index of 140 or less.

11. The process of claim 10, wherein the unconverted product exhibits a pour point of less than −10° C. and a kinematic viscosity at about 100° C. of at least 5 cSt.

12. The process of claim 11, wherein the two-stage catalyst system of the high-conversion hydrocracking stage consists essentially of a mixture of a USY catalyst loaded with from about 0.3 wt % to about 1.5 wt % platinum, based on the weight of the USY catalyst, and a ZSM-48 catalyst loaded with from about 0.3 wt % to about 1.5 wt % platinum, based on the weight of the ZSM-48 catalyst.

13. The process of claim 2, wherein the converted product has a yield of material boiling in the range between 350° F. (177° C.) and 700° F. (371° C.) of at least 45 wt %, based on the total weight of the converted product.

14. The process of claim 13, wherein the converted product exhibits sulfur content of not greater than 10 wppm.

15. The process of claim 14, wherein the unconverted product exhibits a viscosity index of 140 or less.

16. The process of claim 15, wherein the unconverted product exhibits a pour point of less than −10° C. and a kinematic viscosity at about 100° C. of at least 5 cSt.

17. The process of claim 16, wherein the two-stage catalyst system of the high-conversion hydrocracking stage consists essentially of a mixture of a USY catalyst loaded with from about 0.3 wt % to about 1.5 wt % platinum, based on the weight of the USY catalyst, and a ZSM-48 catalyst loaded with from about 0.3 wt % to about 1.5 wt % platinum, based on the weight of the ZSM-48 catalyst.

* * * * *